US009276334B1

(12) United States Patent
Daily et al.

(10) Patent No.: US 9,276,334 B1
(45) Date of Patent: Mar. 1, 2016

(54) POKE-IN ELECTRICAL CONNECTOR

(71) Applicant: Tyco Electronics Corporation, Berwyn, PA (US)

(72) Inventors: Christopher George Daily, Harrisburg, PA (US); Matthew Edward Mostoller, Hummelstown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/568,205

(22) Filed: Dec. 12, 2014

(51) Int. Cl.
*H01R 4/48* (2006.01)
*H01R 9/24* (2006.01)

(52) U.S. Cl.
CPC ..... *H01R 9/2416* (2013.01); *H01R 9/2491* (2013.01)

(58) Field of Classification Search
CPC ..... H01R 4/4845; H01R 9/24
See application file for complete search history.

(56) References Cited

U.S. PATENT DOCUMENTS

| | | | | |
|---|---|---|---|---|
| 7,658,653 | B2 * | 2/2010 | Diekmann | H01H 85/2045 439/715 |
| 8,062,179 | B2 * | 11/2011 | Eriksson | B60W 10/06 477/107 |
| 8,172,623 | B1 * | 5/2012 | Zhu | H01R 13/2428 439/709 |
| 2003/0008569 | A1 * | 1/2003 | Matsumoto | H01R 4/4827 439/835 |

* cited by examiner

*Primary Examiner* — Phuongchi T Nguyen

(57) ABSTRACT

An electrical connector includes a terminal block having a pocket, a poke-in chamber in the pocket configured to receive an electrical wire during a poke-in termination, and a plug channel in the pocket configured to receive a plug contact during a plug mating termination. An electrical contact is received in the pocket having a base held in the pocket and a wire trap beam extending from the base into the poke-in chamber. The wire trap beam is configured to engage the electrical wire when poked-in to the poke-in chamber. A plug interface is arranged in the plug channel. The plug interface has a slot defined by a first arm and a second arm. The first and second arms are configured to engage in physical contact with the plug contact when plugged into the plug channel. The base, wire trap beam and plug interface are a one-piece unitary structure.

22 Claims, 4 Drawing Sheets

POKE-IN ELECTRICAL CONNECTOR

BACKGROUND OF THE INVENTION

The subject matter described herein relates generally to electrical connectors.

Some electrical connectors are mounted to circuit boards and include electrical contacts used to supply and/or receive power to/from the circuit board. For example, in a lighting system, a ballast assembly may be mounted to a circuit board that operates as a driver for controlling lighting of fixtures connected to the ballast assembly. However, various systems have many different ways of electrically connecting the lighting fixtures to the ballast assembly. For example, some systems may use poke-in wire connections. Some systems use small gauge wires while other system use large gauge wires. Other systems may use plug connections. The ballast assemblies must be specifically designed for the particular type of connections.

A need remains for a robust electrical connector for electrically connecting components with a circuit board.

SUMMARY OF THE INVENTION

In one embodiment, an electrical connector is provided including a terminal block having a pocket, a poke-in chamber in the pocket configured to receive an electrical wire during a poke-in termination, and a plug channel in the pocket configured to receive a plug contact during a plug mating termination. An electrical contact is received in the pocket. The electrical contact has a base held in the pocket and a wire trap beam extending from the base into the poke-in chamber. The wire trap beam is configured to engage the electrical wire when poked-in to the poke-in chamber. A plug interface is arranged in the plug channel. The plug interface has a slot, defined by a first arm and a second arm. The first and second arms are configured to engage in physical contact with the plug contact when plugged into the plug channel. The base, wire trap beam and plug interface are a one-piece unitary structure.

In another embodiment, an electrical connector is provided including a terminal block having bottom, a top, a front, a rear and opposed sides, the bottom configured to be mounted to a circuit board. The terminal block has a pocket. The terminal block has a poke-in chamber in the pocket configured to receive an electrical wire during a poke-in termination. The poke-in chamber is open to at least one of the top, the front and the rear. The terminal block has a plug channel in the pocket configured to receive a plug contact during a plug mating termination. The plug channel is open to at least one of the top, the front and the rear. The terminal block has a pin opening through the bottom. An electrical contact is received in the pocket. The electrical contact has a base held in the pocket. The electrical contact has a wire trap beam extending from the base into the poke-in chamber configured to engage the electrical wire when poked-in to the poke-in chamber. The electrical contact has a plug interface arranged in the plug channel configured to engage in physical contact with the plug contact when plugged into the plug channel. The electrical contact has a pin extending from the base through the pin opening configured to be terminated to the circuit board. The base, wire trap beam, plug interface and pin are a one-piece unitary structure.

In a further embodiment, a lighting system is provided including a circuit board having, a first mounting pad and a second mounting pad and electrical connectors mounted to the first and second mounting pads of the circuit board. Each electrical connector includes a terminal block having a bottom mounted to the circuit board at a corresponding mounting pad location. The terminal block has a pin opening through the bottom. The terminal block has a pocket. The terminal block has a poke-in chamber in the pocket configured to receive an electrical wire during a poke-in termination and a plug channel in the pocket configured to receive a plug contact during a plug mating termination. Each electrical connector includes an electrical contact received in the pocket. The electrical contact has a base held in the pocket. The electrical contact has a wire trap beam extending from the base into the poke-in chamber configured to engage the electrical, wire when poked-in to the poke-in chamber. The electrical contact has a plug interface arranged in the plug channel. The plug interface has a slot defined by a first arm and a second arm. The first and second arms are configured to engage in physical contact with the plug contact when plugged into the plug channel. The electrical contact has a pin extending from the base. The pin is terminated to the corresponding mounting pad at the mounting pad location. The base, wire trap beam, plug interface and pin are a one-piece unitary structure.

DETAILED DESCRIPTION OF THE DRAWINGS

Figure 1:
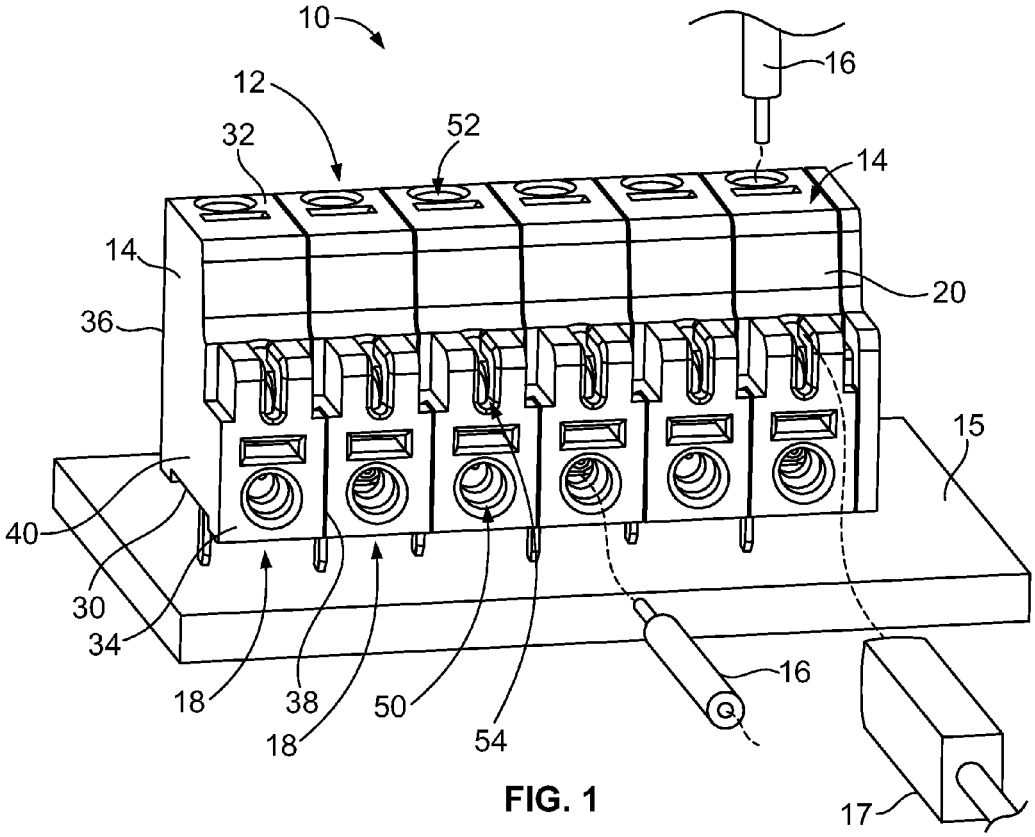
FIG. 1 is an exploded perspective view of an embodiment of an electrical system.

FIG. 1 is an exploded perspective view of an embodiment of an electrical system 10. In some embodiments, the electrical system 10 may be a lighting system and may be referred to hereinafter as lighting system 10. The electrical system 10 may be used to provide power between components. In the illustrated embodiment, the lighting system 10 includes a ballast assembly 12 (or more generically referred to as a connector assembly 12), including a plurality of electrical connectors 14. The lighting system 10 includes a circuit board 15 and the electrical connectors 14 are mounted to the circuit board 15. Any number of electrical connectors 14 may be used in the ballast assembly 12, including a single electrical connector 14. The electrical connectors 14 may be ganged together into a unit defining the ballast assembly 12 and then mounted to the circuit board 15.

Electrical wires 16 and/or plug connectors 17 may be terminated to any of the electrical connectors 14. The electrical wires 16 and/or plug connectors 17 may be electrically connected to other components, such as lighting fixtures or other types of components. The electrical wires 16 and/or plug connectors 17 may supply or deliver power between the various components. In some embodiments, the electrical wires 16 and/or plug connectors 17 may provide power to the circuit board 15, in other embodiments, the electrical wires 16 and/or plug connectors 17 may provide power from the circuit board 15 to other components. Optionally, each electrical connector 14 may be terminated to more than one component, such as one plug connector 17 and one electrical wire 16; two electrical wires 16, or two plug connectors 17. In such embodiments, the electrical connector 14 is used to daisy-chain or otherwise electrically connect multiple circuits together using a single electrical connector 14. Alternatively, only one of the plug connector 17 or the electrical wire 16 may be terminated to the corresponding electrical connector 14.

The circuit board 15 has a plurality of mounting, pads 18 at various mounting locations. Each electrical connector 14 is terminated to a corresponding mounting pad 18. The mounting pad 18 may include vias, solder pads, or other circuit components that allow electrical connection of the electrical connector 14 to the circuit board 15. The circuit board 15 may operate as a driver for the lighting system 10 controlling operation or powering, of various lighting fixtures, which are electrically connected to the circuit board 15 via the electrical connectors 14 and the electrical wires 16 and/or plug connectors 17. Electrical contacts 22 (shown in FIG. 2) of the electrical connectors 14 are configured to be terminated to the mounting pads 18 of the circuit board 15 to establish an electrical connection between the electrical connectors 14 and the circuit board 15. The electrical connectors 14 electrically connect the electrical wires 16 and/or the plug connectors 17 with the circuit board 15.

The electrical connector 14 defines both a poke-in style connector that allows the electrical wires 16 to be poked-in to the electrical connector 14 for termination to the electrical contacts 22 and a receptacle style connector that allows the plug connectors 17 to be plugged into the electrical connectors 14 for termination to the electrical contacts 22. Having dual mating styles accommodates various systems and system components.

Although the electrical connectors 14 are shown as defining a portion of the ballast assembly 12, the electrical connectors 14 are not limited to being used as a portion of a ballast assembly or in a lighting system. Rather, the electrical connectors 14 additionally or alternatively ma mate with any other device besides lighting components and may be used to terminate electrical wires for any other electrical device besides a lighting system. The lighting system 10 and the ballast assembly 12 are meant as only one exemplary application of the electrical connectors 14.

Each electrical connector 14 includes a terminal block 20 holding a corresponding electrical contact 22. The terminal block 20 includes a bottom 30, a top 32, a front 34, a rear 36 and opposite sides 38, 40. The terminal blocks 20 are stacked side-by-side such that the first side 38 of one terminal block 20 engages the second side 40 of an adjacent terminal block 20. The bottom 30 is mounted to the circuit board 15. In an exemplary embodiment, the top 32, front 34 and rear 36 are exposed and capable of receiving mating components, such as a corresponding electrical wire 16 or plug connector 17. In an exemplary embodiment, the terminal block 20 includes an internal pocket 42 (shown in FIG. 2) that receives the electrical contact 22. The electrical wire 16 and/or plug connector 17 may be at least partially received in the pocket 42 for mating with the electrical contact 22.

The terminal block 20 includes at least one poke-in chamber configured to receive a corresponding electrical wire 16 and at least one plug channel configured to receive a corresponding plug connector 17. For example, in the illustrated embodiment, the terminal block 20 includes a front poke-in chamber 50, a top poke-in chamber 52 and a front plug channel 54. The poke-in chamber 50 is configured to receive the corresponding electrical wire 16 from the front, whereas the poke-in chamber 52 is configured to receive the electrical wire 16 from the top. The plug, channel 54 is configured to receive the plug connector 17 from the front. However, other arrangements are possible in alternative embodiments. For example, the terminal block 20 may include a rear poke-in chamber at the rear 36. The terminal block 20 may include a top plug channel configured to receive a corresponding plug connector 17 from the top. Optionally, the top plug channel may be situated in a similar or the same position as the front plug channel 54 illustrated in FIG. 1, however the terminal block 20 and/or plug connector 17 may be designed to be plugged into the plug channel 54 from the top. Alternatively, the top plug channel 54 may be provided at a different location, such as closer to the top poke-in chamber 52. The terminal block 20 may include a rear plug channel at the rear 36.

The poke-in chambers 50, 52 are configured tar receive corresponding electrical wires 16 during corresponding poke-in terminations. The plug channel 54 is configured to receive the plug connector 17 during a plug mating termination. For example, a plug contact 100 (shown in FIG. 6) of the plug connector 17 may be received in the plug channel 54 and electrically connected to the electrical contact 22. Optionally, in some embodiments, only one of the poke-in chambers 50 or 52 receives the corresponding electrical wire 16 at a time. In other embodiments, both poke-in chambers 50, 52 receive corresponding electrical wires 16 at the same time. In other variations, neither the poke-in chamber 50 nor the poke-in chamber 52 receives an electrical wire 16, but rather the plug channel 54 receives the corresponding plug connector 17. In other various embodiments, the plug channel 54 may receive the plug connector 17 while the poke-in chamber 52 and/or 50 receives the corresponding electrical wire 16. As such, at any given time, multiple mating components may be electrically connected to the electrical contact 22.

Figure 2:
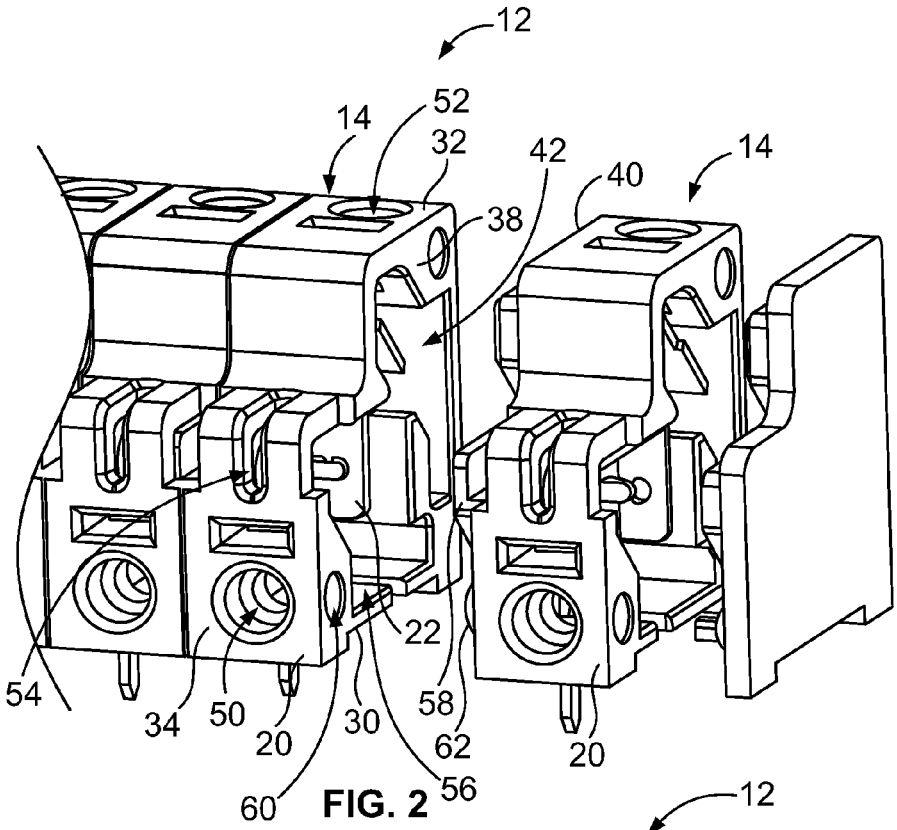
FIG. 2 is a front perspective view of a portion of an electrical assembly of the electrical system showing electrical connectors thereof.
Figure 3:
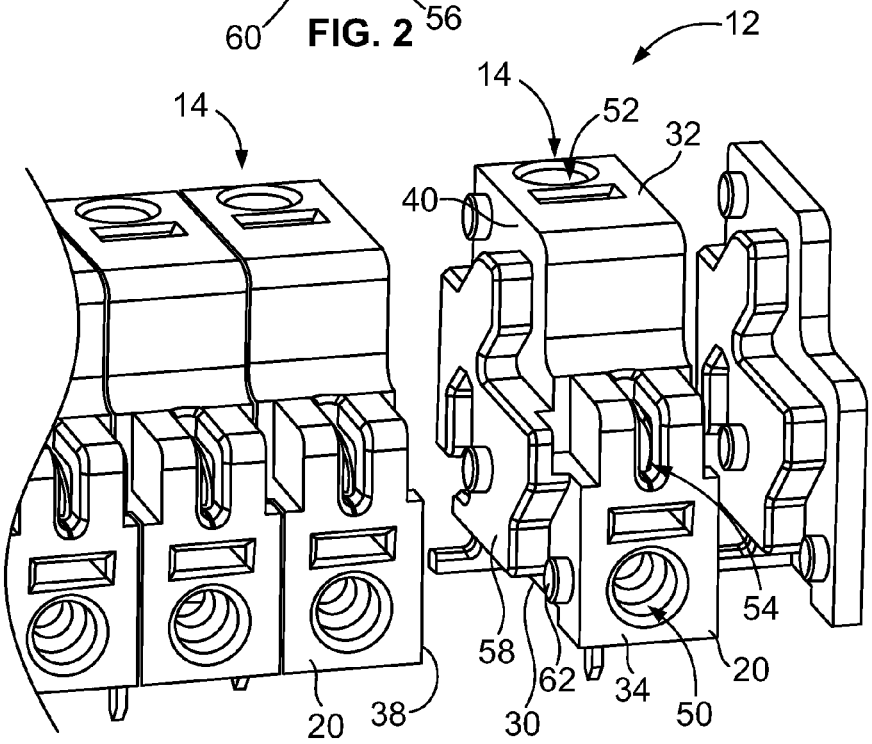
FIG. 3 is a front perspective view of a portion of the electrical assembly showing the electrical connectors.

FIG. 2 is a front perspective view of a portion of the ballast assembly 12 showing one of the electrical connectors 14 poised for mating with another electrical connector 14. FIG. 3 is another front perspective view of a portion of the ballast assembly 12 showing one of the electrical connectors 14 poised for mating with the other electrical connector 14. FIG. 2 illustrates the pocket 42 of the terminal block 20. The pocket 42 receives the electrical contact 22. The pocket 42 may be open at the side 38 to allow the electrical contact 22 to be loaded into the pocket 42 through the side 38.

The poke-in chambers 50, 52 and plug channel 54 are part of the pocket 42 and extend to the exterior of the terminal block 20. For example, the poke-in chamber 50 extends from the internal portion of the pocket 42 to the front 34. The poke-in chamber 52 extends from the internal portion of the pocket 42 to the top 32. In the illustrated embodiment, the plug channel 54 extends from the internal portion of the pocket 42 to the front 34 and the top 32; however, the plug channel 54 may only be open to the front 34 or to the top 32 in alternative embodiments.

In an exemplary embodiment, the terminal block 20 includes a pin opening 56 in the bottom 30. The pin opening 56 is open to the pocket 42 and allows the electrical contact 22 to extend from the pocket 42 through the terminal block 20 for termination to the circuit board 15 (shown in FIG. 1).

As shown in FIG. 3, the terminal block 20 includes a boss 58 extending from the side 40. The boss 58 is sized and shaped to fit within the pocket 42 of the adjacent terminal block 20. The boss 58 may be used to secure the electrical contact 22 in the adjacent terminal block 20. The boss 58 may engage the electrical contact 22 held in the adjacent terminal block 20. Optionally, a portion of the boss 58 may extend into the pin opening 56 of the adjacent terminal block 20.

In an exemplary embodiment, the terminal blocks 20 include retention features used to secure the terminal blocks 20 together. For example, in the illustrated embodiment, the terminal blocks 20 include retention openings 60 in the first side 38 and retention posts 62 extending from the second side 40. When the terminal blocks 20 are pressed together, the retention posts 62 are received in corresponding retention openings 60 to hold the terminal blocks 20 together. Optionally, the retention posts 62 may be held in the retention openings 60 by an interference fit. Optionally, adhesive may be used to secure the terminal blocks 20 together. Other types of retention features ma be used in alternative embodiments to secure the terminal blocks 20 to each other.

Figure 4:
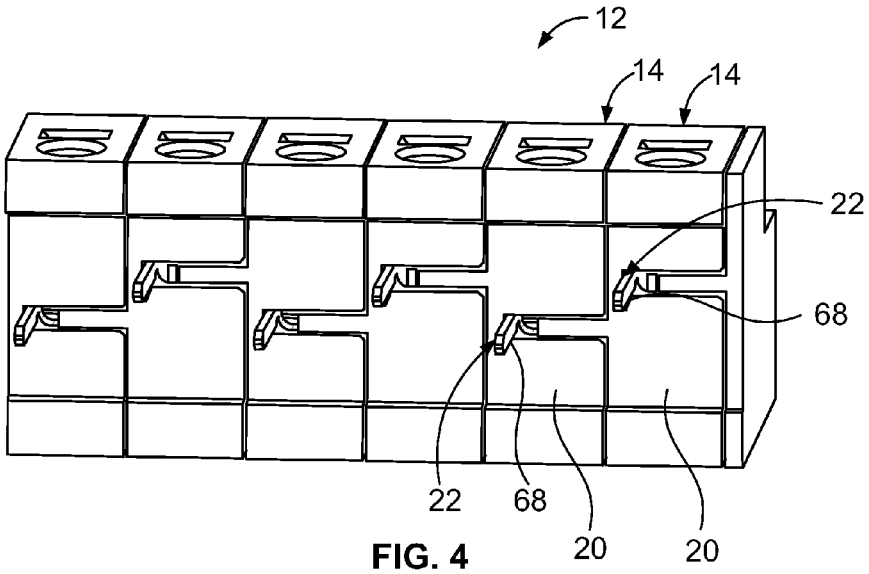
FIG. 4 is a bottom perspective of the electrical assembly.

FIG. 4 is a bottom perspective of the ballast assembly 12 showing, the electrical connectors 14 coupled together. Pins 68 of the electrical contacts 22 extend from the terminal blocks 20 for termination to the circuit board 15. For example, the pins 68 may be solder pins configured to be received in vias of the circuit board 15 and soldered thereto. Other types of pins 68 may be used in alternative embodiments, such as compliant pins, surface mount solder pins, and the like. Optionally, the pins 68 may be staggered front to back on adjacent terminal blocks 20 to increase clearance and creep depth distance between the pins 68. Having greater electrical spacing between the pins 68 of the electrical contacts 22 allows the electrical contacts 22 to carry higher voltage.

Figure 5:
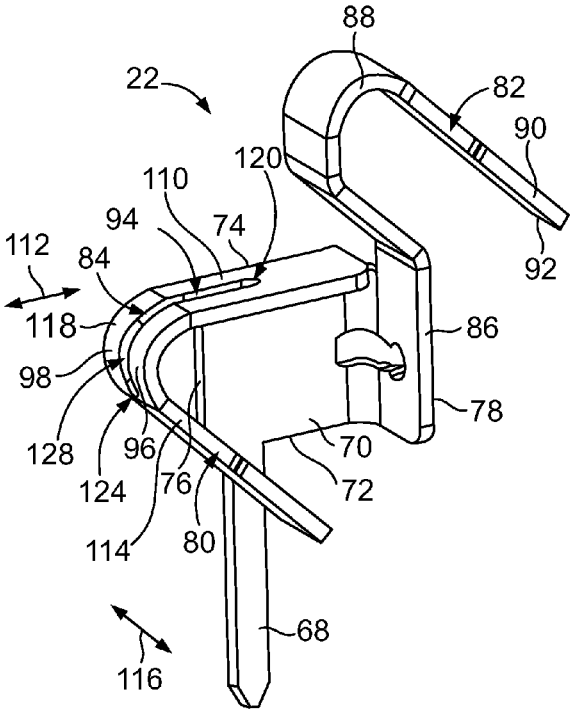
FIG. 5 is a front perspective view of an electrical contact for the electrical connector.
Figure 6:
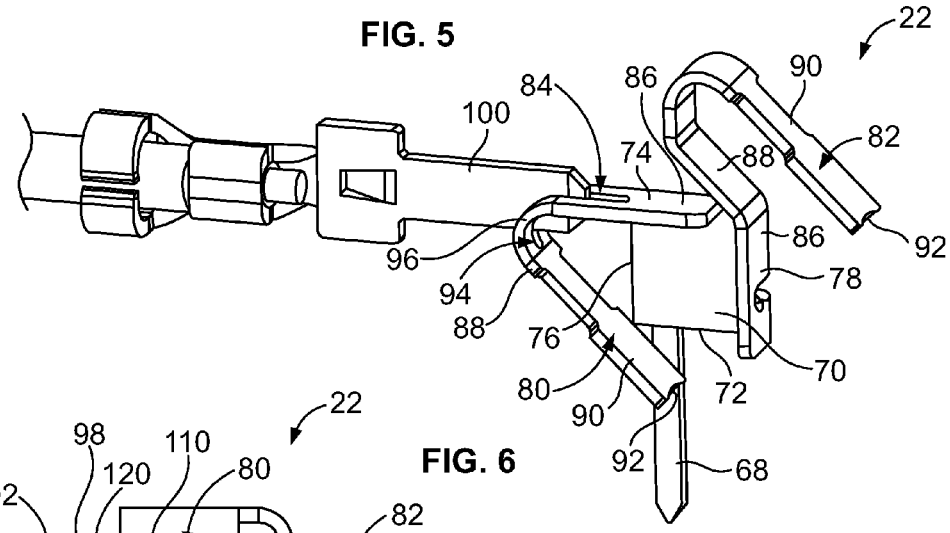
FIG. 6 is a rear perspective view of the electrical contact.
Figure 7:
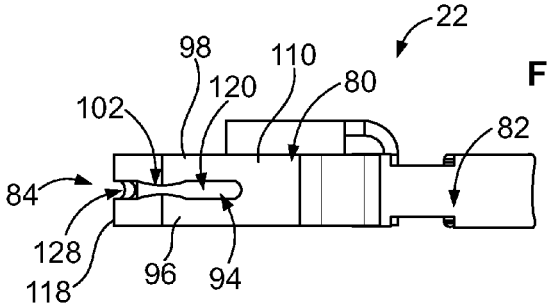
FIG. 7 is a top view of the electrical contact.

FIG. 5 is a front perspective view of the electrical contact 22. FIG. 6 is a rear perspective view of the electrical contact 22. FIG. 7 is a top view of the electrical contact 22. The electrical contact 22 is manufactured from a conductive material, such as a copper material. The electrical contact 22 includes a stamped a formed body which may be stamped from a blank or sheet of copper material and formed into a final shape. The electrical contact 22 is a one piece unitary structure that is configured to be electrically connected to the circuit board 15, electrical wires 16 and plug contact 100 of the plug connector 17, all shown in FIG. 1.

The electrical contact 22 includes a base 70 having a bottom 72, a top 74, a front 76 and a rear 78. The pin 68 extends from the bottom 72 of the base 70. Optionally, different versions of the electrical contact 22 may have the pin 68 extend from different portions of the base 70, such as closer to the front 76 or closer to the rear 78 to provide the staggering of the pins 68 in different electrical connectors 14 for example, as shown in FIG. 4).

The electrical contact 22 includes a first wire trap beam 80 extending from the base 70 and a second wire trap beam 82 extending from the base 70. The wire trap beams 80, 82 are configured to engage corresponding electrical wires 16 when poked-in to the electrical connector 14.

The electrical contact 22 includes a plug interface 84 configured to engage the plug contact 100 when the plug connector 17 is mated with the electrical connector 14. In the illustrated embodiment, the plug interface 84 is provided on the wire trap beam 80; however, in alternative embodiments, a separate plug interface 84 may extend from the base 70. In other alternative embodiments, the plug interface 84 may be provided on the wire trap beam 82.

The wire traps beams 80, 82 are configured to engage the corresponding electrical wires 16 in a poke-in or pinching type of connection. In an exemplary embodiment, each wire trap beam 80, 82 is folder over to one side of the base 70 and includes a fixed end portion 86 at the base 70. A spring beam portion 88 extends from the fixed end portion 86 to a wire end portion 90. The wire end portion 90 is configured to engage the corresponding electrical wire 16. The spring beam portion 88 may follow as generally arcuate path to position the wire end portion 90 relative to the base 70 within the electrical connector 14 for mating with the corresponding electrical wire 16. The spring bream portion 88 may have a long effective length to provide good spring characteristics. When the spring bream portion 88 is deformed and flexed inward, such as when the electrical wire 16 is mated with the electrical contact 22, the spring bream portion 88 may be spring biased against the electrical wire 16. The long effective length reduces the risk of plastic deformation, thus ensuring that the electrical contact 22 maintains the spring characteristics.

An edge 92 is defined at the distal end of the wire end portion 90. The edge 92 is configured to engage in physical contact with the electrical wire 16. The edge 92 may have a concave curvature to follow the electrical wire 16. The edge 92 may or may not puncture the electrical wire 16. The edge 92 may facilitate holding the corresponding electrical wire 16 to the electrical contact 22 (i.e., may facilitate maintaining the mechanical and electrical connection between the electrical wire 16 and the electrical contact 22), for example via stiction between the edge 92 and the electrical wire 16, via compression of the electrical wire 16, and/or via puncturing of the electrical wire 16. For example, the edge 92 may increase the force required to pull the corresponding electrical wire 16 out of the electrical connector 14.

During insertion or poke-in of the electrical wire 16 against the electrical contact 22, the electrical wire 16 forces the electrical contact 22 to flex or move inward. The spring beam portion 88 causes the wire end portion 90 to press outward against the electrical wire 16 sandwiching or pinching the electrical wire 16 between the wire end portion 90 and a portion of the terminal block 20. The spring beam portion 88 is spring biased against the electrical wire 16 to ensure a reliable electrical connection between the electrical contact 22 and the electrical wire 16. The edge 92 may engage or dig into the electrical conductor of the electrical wire 16.

The pinch connection between the wire end portion 90 and the electrical wire 16 is optionally a separable connection. A separable connection is a connection wherein the electrical wire 16 can be terminated by the electrical contact 22 without damaging the electrical contact 22 and/or without damaging the electrical wire 16. For example, a "separable connection" may be a connection wherein: (1) the corresponding electrical wire 16 can be installed to the electrical contact 22 (i.e., captured with the compliant pinch connection) and later uninstalled from the electrical contact 22 (i.e., removed from the terminal block 20) without damaging the electrical contact 22 such that another electrical wire 16 can be installed to the electrical contact 22 and/or (2) the corresponding electrical wire 16 can be installed in the same or another location.

Optionally, the spring beam portion 88 is compliant and flexible to enable the electrical contact 22 to accommodate a larger range of sizes of electrical wires. For example, the electrical contact 22 may be capable of accommodating at least four different sizes of electrical wires, such as, but not limited to, between 18-24 AWG. Optionally, the first wire trap beam 80 may be used with a first range of electrical wires 16 and the second wire trap beam 82 may be used with a second range of electrical wires 16.

The plug interface 84 includes a slot 94 defined by a first arm 96 and a second arm 98. The slot 94 is configured to receive the plug contact 100 (shown in FIG. 6) of the plug connector 17. The first and second arms 96, 98 may engage opposite sides of the plug contact 100 to ensure an electrical connection between the electrical contact 22 and the plug contact 100. Optionally, the plug interface 84 may include a necked-down portion 102 where the slot 94 has a decreased width. The width of the necked-down portion 102 may be less than the width of the plug contact 100, thus ensuring that the plug interface 84 has a reliable electrical connection with the plug contact 100. When the plug contact 100 is plugged into the plug interface 84, the first and second arms 96, 98 are deflected outward and spring biased against the plug contact 100 ensuring electrical connection therebetween.

In the illustrated embodiment, the slot 94 is defined in the wire trap beam 80. For example, the first and second arms 96, 98 are portions of the wire trap beam 80. The spring beam portion 88 of the wire trap beam 80 includes a first section 110 extending forward from the base 70 in a first direction 112 and a second section 114 angled transverse to the first section 110 in a second direction 116. For example, the second direction 116 may be approximately 45° relative to the first direction 112. A folded corner 118 is provided between the first section 110 and the second section 114. The folded corner 118 may give the spring beam portion 88 the spring characteristics needed to ensure electrical connection is maintained between the electrical contact 22 and the electrical wire 16. The plug interface 84 is provided at the folded corner 118. For example, a first portion 120 of the slot 94 extends along the first section 110 of the wire trap beam 80. A second portion 124 of the slot 94 extends along the second section 114 of the wire trap beam 80. A third portion 128 of the slot 94 extends along the folded corner 118 between the first and second sections 110, 114 of the slot 94. The slot 94 is configured to receive the plug contact 100 from the front in a mating direction that is generally parallel to the first direction 112. The plug contact 100 may be loaded into the slot 94 from other directions in alternative embodiments.

Having the pin 68, wire trap beams 80, 82 and plug interface 84 all part of the same one piece unitary structure of the electrical contact 22 allows the electrical contact 22 to be used in many different ways. For example, the same electrical contact 22 may be used to electrically connect the circuit board 15 to a single electrical wire 16, to multiple electrical wires 16, to a single plug contact 100 of a plug connector 17 or to the plug contact 100 and one or more electrical wires 16 at the same time.

Figure 8:
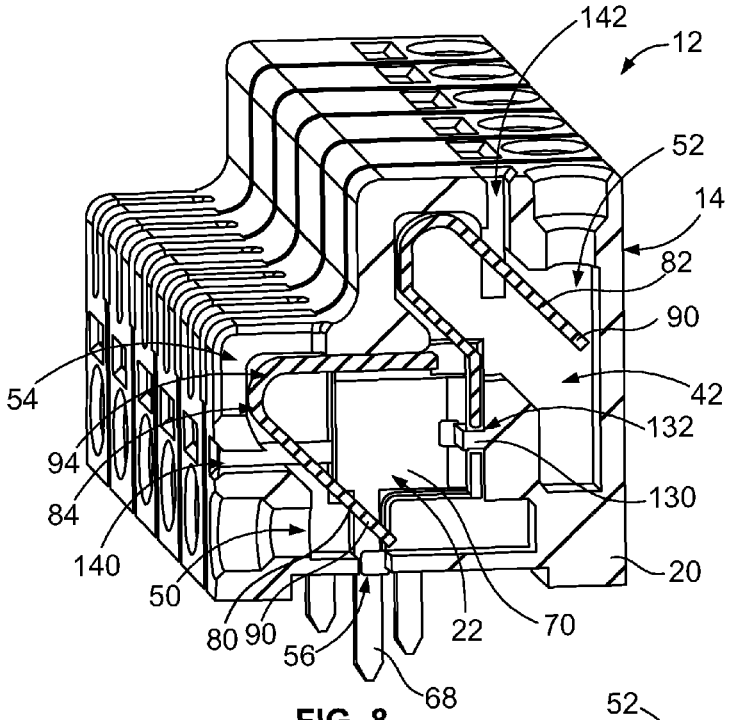
FIG. 8 is a cross sectional view of a portion of the electrical assembly taken through one of the electrical connectors.

FIG. 8 is a cross sectional view of a portion of the ballast assembly 12 taken through one of the electrical connectors 14. The electrical contact 22 is shown within the pocket 42 of the terminal block 20. The terminal block 20 includes an alignment rib 130 extending into the pocket 42. The base 70 and/or wire trap beam 82 of the electrical contact 22 includes an alignment slot 132 that receives the alignment rib 130 to orient the electrical contact 22 in the pocket 42. For example, when the contact 22 is side loaded into the pocket 42 the alignment rib 130 is received in the alignment slot 132. The alignment rib 130 may vertically align the electrical contact 22 within the pocket 42 and/or horizontally align the electrical contact 22 within the pocket 42. Other alignment features may be provided in various embodiments to align the electrical contact 22 within the pocket 42.

When the electrical contact 22 is positioned within the pocket 42, the first wire trap beam 80 is positioned in the pocket 42 in the poke-in chamber 50 of the pocket 42. The wire end portion 90 is aligned with the opening in the terminal block 20 for receiving the electrical wire 1 when poked-in to the poke-in chamber 50. The second wire trap beam 82 is positioned in the pocket 42 in the poke-in chamber 52 of the pocket 42. The wire end portion 90 of the wire trap beam 82 is aligned with the opening in the terminal block 20 to receive the electrical wire 16 poked-in to the poke-in chamber 52. The plug interface 84 is positioned in the plug, channel 54 of the pocket 42. The slot 94 is aligned with the opening in the terminal block 20 to receive the plug contact 100 of the plug connector 17 when plugged into the plug channel 54. The pin 68 extends through the pin opening 56 for termination to the circuit board 15.

In an exemplary embodiment, the terminal block 20 includes wire release openings 140, 142 associated with the poke-in chambers 50, 52, respectively. The wire release openings 140, 142 may receive a tool or device used to release the wire trap beams 80, 82 from the electrical wires 16.

Figure 9:
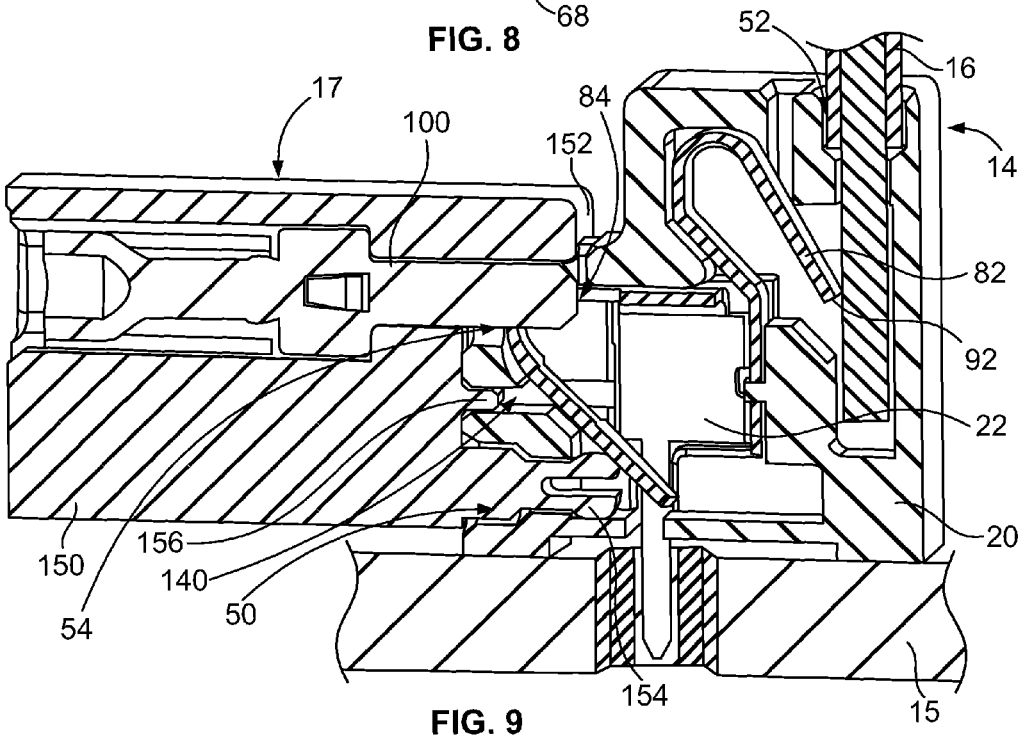
FIG. 9 is a cross section view of the electrical connector showing, a plug connector mated to the electrical connector and showing an electrical wire mated to the electrical connector in accordance with an exemplary embodiment.

FIG. 9 is a cross section view of the electrical connector 14 showing the plug connector 17 mated to the electrical connector 14 and showing one of the electrical wires 16 mated to the electrical connector 14. The electrical wire 16 is poked-in to the top poke-in chamber 52 for electrical connection with the top wire trap beam 82. The wire trap beam 82 is deflected when the electrical wire 16 is poked-in to the poke-in chamber 52. The edge 92 of the wire trap beam 82 engages the electrical conductor of the electrical wire 16.

The plug connector 17 includes a plug housing 150 holding the plug contact 100. A mating end 152 of the plug connector 17 is mated to the terminal block 20. In an exemplary embodiment, the plug connector 17 includes a retention member 154 used to retain the plug connector 17 to the electrical connector 14. For example, the retention member 154 may be received in the poke-in chamber 50. Detents of the retention member 154 secure the retention member 154 in the poke-in chamber 50. In an exemplary embodiment, the plug connector 17 may include a guide rib 156 that is configured to be received in the wire release opening 140. A guide rib 156 may align the plug connector 17 with the terminal block 20. When the plug connector 17 is plugged onto the electrical connector 14, the plug contact 100 is received in the plug channel 54. The plug contact 100 is mated with the plug interface 84 to create an electrical connection between the plug contact 100 and the electrical contact 22. Power may be supplied from the circuit board. 15 to both the plug connector 17 and the electrical wire 16 by the electrical contact 22.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the an upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a terminal block having a pocket, the terminal block having a poke-in chamber in the pocket configured to receive an electrical wire during a poke-in termination, the terminal block having a plug channel in the pocket configured to receive a plug contact during a plug mating termination; and an electrical contact received in the pocket, the electrical contact having a base held in the pocket, the electrical contact having a wire trap beam extending from the base into the poke-in chamber, the wire trap beam configured to engage the electrical wire when poked-in to the poke-in chamber, the electrical contact having a plug interface arranged in the plug channel, the plug interface having a slot defined by a first arm and a second arm, the first and second arms configured to engage in physical contact with the plug contact when plugged into the plug channel;

wherein the base, wire trap beam and plug interface are a one-piece unitary structure.

2. The electrical connector of claim 1, wherein the electrical contact is configured to be coupled to only one of the electrical wire at the wire trap beam or the plug contact at the plug interface at a time.

3. The electrical connector of claim 1, wherein the electrical contact is configured to be coupled to both the electrical wire at the wire trap beam and the plug contact at the plug interface at the same time.

4. The electrical connector of claim 1, wherein the electrical contact includes a stamped and formed body including the base, the wire trap beam, and the plug interface defining the one piece unitary structure.

5. The electrical connector of claim 1, wherein the poke-in chamber is configured to receive a portion of a plug connector, which includes the plug contact, when the plug contact is plugged into the plug chamber.

6. The electrical connector of claim 1, further comprising a second wire trap beam extending from the base, the terminal block including a second poke-in chamber in the pocket configured to receive a different electrical wire during a poke-in termination.

7. The electrical connector of claim 1, wherein the pocket is open at a side of the terminal block, the electrical contact being loaded into the pocket through the side.

8. The electrical connector of claim 1, wherein the terminal block includes a boss extending from a side of the terminal block, the boss being configured to be loaded into a corresponding pocket of a terminal block of an adjacent electrical connector.

9. The electrical connector of claim 1, wherein the terminal block includes an alignment rib extending into the pocket, the base of the electrical contact includes an alignment slot receiving the alignment rib to orient the electrical contact in the pocket.

10. The electrical connector of claim 1, wherein the electrical contact has a pin extending from the base, the pin being configured to be terminated directly to a circuit board to electrically connect to the circuit board.

11. The electrical connector of claim 1, wherein the housing includes a pinch wall defining a portion of the poke-in chamber, the wire trap beam configured to pinch the electrical wire against the pinch wall.

12. The electrical connector of claim 1, wherein the plug interface is provided on the wire trap beam.

13. The electrical connector of claim 12, wherein the wire trap beam includes the first and second arms defining the slot.

14. The electrical connector of claim 1, wherein the wire trap beam includes a first section extending forward from the base in a first direction and a second section angled transverse to the first section with a folded corner therebetween, the plug interface being provided at the folded corner.

15. The electrical connector of claim 14, wherein a first portion of the slot extends along the first section of the wire trap beam, a second portion of the slot extends along the second section of the wire trap beam, and a third portion of the slot extends along the folded corner between the first and second sections of the slot.

16. The electrical connector of claim 1, wherein the terminal block includes a bottom, a top, a front, a rear and opposite sides, the poke-in chamber being opened to at least one of the top, the front, or the rear, the plug channel being open to at least one of the top, the front, or the rear.

17. The electrical connector of claim 16, wherein the poke-in chamber and the plug channel are open to different ones of the top, the front, and the rear.

18. The electrical connector of claim 1, wherein the terminal block includes a top and a front, the poke-in chamber being open to the front, the plug channel being open to at least one of the top and the front.

19. The electrical connector of claim 18, further comprising a second poke-in chamber being open to the top, the electrical contact comprising a second wire trap beam extending from the base into the second poke-in chamber.

20. The electrical connector of claim 19, wherein the first poke-in chamber is configured to receive the corresponding electrical wire in a first direction and the second poke-in chamber is configured to receive the corresponding electrical wire in a second direction generally perpendicular to the first direction.

21. An electrical connector comprising:

a terminal block having bottom, a top, a front, a rear and opposed sides, the bottom configured to be mounted to a circuit board, the terminal block having a pocket, the terminal block having a poke-in chamber in the pocket configured to receive an electrical wire during a poke-in termination, the poke-in chamber being open to at least one of the top, the front and the rear, the terminal block having a plug channel in the pocket configured to receive a plug contact during a plug mating termination, the plug channel being open to at least one of the top, the front and the rear, the terminal block having a pin opening through the bottom; and an electrical contact received in the pocket, the electrical contact having a base held in the pocket, the electrical contact having a wire trap beam extending from the base into the poke-in chamber, the wire trap beam configured to engage the electrical wire when poked-in to the poke-in chamber, the electrical contact having a plug interface arranged in the plug channel, the plug interface configured to engage in physical contact with the plug contact when plugged into the plug channel, the electrical contact having a pin extending from the base through the pin opening, the pin configured to be terminated to the circuit board;

wherein the base, wire trap beam, plug interface and pin are a one-piece unitary structure.

22. A lighting system comprising:

a circuit board having a first mounting pad and a second mounting pad; and electrical connectors mounted to the first and second mounting pads of the circuit board, each electrical connector comprising:

a terminal block having a bottom mounted to the circuit board at a corresponding mounting pad location, the terminal block having a pin opening through the bottom, the terminal block having a pocket, the terminal block having a poke-in chamber in the pocket configured to receive an electrical wire during a poke-in termination, the terminal block having a plug channel in the pocket configured to receive a plug contact during a plug mating termination; and an electrical contact received in the pocket, the electrical contact having a base held in the pocket, the electrical contact having a wire trap beam extending from the base into the poke-in chamber, the wire trap beam configured to engage the electrical wire when poked-in to the poke-in chamber, the electrical contact having a plug interface arranged in the plug channel, the plug interface having a slot defined by a first arm and a second arm, the first and second arms configured to engage in physical contact with the plug contact when plugged into the plug channel, the electrical contact having a pin extending from the base, the pin being terminated to the corresponding mounting pad at the mounting pad location, wherein the base, wire trap beam, plug interface and pin are a one-piece unitary structure.

* * * * *